US008058544B2

(12) United States Patent
Hoeberechts et al.

(10) Patent No.: US 8,058,544 B2
(45) Date of Patent: Nov. 15, 2011

(54) FLEXIBLE MUSIC COMPOSITION ENGINE

(75) Inventors: Maia Hoeberechts, London (CA); Ryan Demopoulos, Bellevue, WA (US); Michael Katchabaw, London (CA)

(73) Assignee: The University of Western Ontario, London, Ontario (CA)

( * ) Notice: Subject to any disclaimer, the term of this patent is extended or adjusted under 35 U.S.C. 154(b) by 0 days.

(21) Appl. No.: 12/679,086

(22) PCT Filed: Sep. 19, 2008

(86) PCT No.: PCT/CA2008/001648

§ 371 (c)(1),
(2), (4) Date: Mar. 19, 2010

(87) PCT Pub. No.: WO2009/036564

PCT Pub. Date: Mar. 26, 2009

(65) Prior Publication Data

US 2010/0307320 A1 Dec. 9, 2010

Related U.S. Application Data

(60) Provisional application No. 60/974,109, filed on Sep. 21, 2007.

(51) Int. Cl.
*G10H 1/00* (2006.01)

(52) U.S. Cl. ..... 84/609; 84/610; 84/622; 84/625; 84/649; 84/650; 84/659; 84/660

(58) Field of Classification Search ..... None
See application file for complete search history.

(56) References Cited

U.S. PATENT DOCUMENTS

| | | | | |
|---|---|---|---|---|
| 5,412,154 | A | 5/1995 | Takeda et al. | |
| 6,395,970 | B2 * | 5/2002 | Aoki | 84/613 |
| 6,683,241 | B2 * | 1/2004 | Wieder | 84/609 |
| 7,250,567 | B2 * | 7/2007 | Gayama | 84/613 |
| 7,279,629 | B2 * | 10/2007 | Hinman et al. | 84/615 |
| 7,319,185 | B1 * | 1/2008 | Wieder | 84/609 |
| 7,601,904 | B2 * | 10/2009 | Dreyfuss et al. | 84/600 |
| 7,732,697 | B1 * | 6/2010 | Wieder | 84/609 |
| 7,790,974 | B2 * | 9/2010 | Sherwani et al. | 84/609 |
| 7,858,867 | B2 * | 12/2010 | Sherwani et al. | 84/609 |
| 2003/0037664 | A1 | 2/2003 | Comair et al. | |
| 2003/0084779 | A1 * | 5/2003 | Wieder | 84/609 |
| 2004/0264506 | A1 | 12/2004 | Furukawa | |
| 2005/0120868 | A1 * | 6/2005 | Hinman et al. | 84/615 |
| 2006/0230910 | A1 * | 10/2006 | Song et al. | 84/616 |
| 2007/0169608 | A1 | 7/2007 | Fujiwara | |
| 2007/0261535 | A1 * | 11/2007 | Sherwani et al. | 84/609 |
| 2008/0314228 | A1 * | 12/2008 | Dreyfuss et al. | 84/477 R |
| 2010/0288106 | A1 * | 11/2010 | Sherwani et al. | 84/609 |

* cited by examiner

OTHER PUBLICATIONS

PCT/CA2008/001648, mail date Nov. 12, 2008, International Search Report.

*Primary Examiner* — Marlo Fletcher
(74) *Attorney, Agent, or Firm* — Workman Nydegger

(57) ABSTRACT

An apparatus, method and system for generating music in real time are provided. A pipeline for coordinating generation of a musical piece is created. At least one producer is loaded into the pipeline, the at least one producer for producing at least one high level musical element of the musical piece, independent of other producers in the pipeline. At least one generator is called by the at least one producer, the at least one generator for generating at least one low level music element of the musical piece. The at least one low level musical element and the at least one high level musical element are integrated, such that the musical piece is generated in real time.

20 Claims, 11 Drawing Sheets

FLEXIBLE MUSIC COMPOSITION ENGINE

CROSS REFERENCE TO RELATED APPLICATIONS

This application is a National Phase entry of International Patent Application Serial No. PCT/CA2008/001648 filed 19 Sep. 2008, and claims the benefit of priority of U.S. Provisional Patent Application No. 60/974,109 filed 21 Sep. 2007, which are hereby incorporated by reference.

FIELD

The specification relates generally to automated music composition, and specifically to an apparatus, method, and system for a flexible music composition engine which generates music in real time.

BACKGROUND

There is increasing interest and demand for adaptive music composition systems, which can change the character of generated music in real time, for use in diverse areas such as video game music generation, film score composition, and development of interactive composition tools. Previous music composition systems have tended to be monolithic and complex in their approach to automated music composition and have not been successful in mimicking human composed pieces of music. Furthermore, previous music composition systems have not been successful at adapting the music being generated to mood as it develops in a game or a film etc. Rather, the previous music composition systems rely on calling up different snippets of music that are classified under the given mood. This can be expensive for the makers of a video game as a composing and/or licensing fee must be paid for each snippet of music used. The complexity of the previous music composition systems have also made them difficult to use by a non-specialist.

SUMMARY

A first aspect of the specification provides a flexible music composition engine, comprising a processing unit. The processing unit is enabled to create a pipeline for coordinating generation of a musical piece. The processing unit is further enabled to load at least one producer into the pipeline, the at least one producer for producing at least one high level musical element of the musical piece, independent of other producers in the pipeline. The processing unit is further enabled to call at least one generator, via the at least one producer, the at least one generator for generating at least one low level musical element of the musical piece. The processing unit is further enabled to integrate the at least one low level musical element and the at least one high level musical element, such that the processing unit produces the musical piece in real time.

The processing unit can be further enabled to: call at least one performer object for controlling the generation of the musical piece; and load the pipeline into the performer object upon initialization of the generation of the musical piece. The performer object can be enabled to make repeated calls on the pipeline until the musical piece is of a given length, and each call, of the repeated calls, generates at least one block of the musical piece.

The at least one generator can be associated with a style of the musical piece, such that the at least one low level musical element provides the musical piece with the style. The at least one producer can be enabled to call a plurality of generators, including the at least one generator, each of the plurality of generators associated with a different style, such that a character of the musical piece can change from the style to the different style when a new generator is called. The processing unit can be further enabled to receive data indicative of the different style and in response trigger the at least one producer to call the generator associated with the different style to change the character of the musical piece in real time.

The processing unit can be further enabled to monitor at least one setting associated with the generation of the musical piece and, in response to a change in the at least one setting, trigger the at least one producer to call a new generator associated with the setting to change the character of the musical piece in real time.

Generating at least one low level musical element can be based on at least one of selecting a pattern from a pattern library and randomly generating the at least one low level musical element. Randomly generating the at least one low level musical element can comprise pseudo-randomly generating the at least one low level musical element such that the same low level musical element is generated for a given seed value. The at least one pattern library can comprise at least one of a harmonic pattern library, a motif pattern library, a meter pattern library and a mode pattern library.

The at least one producer can comprise at least one of:

a section producer for producing at least one section of the musical piece;

a block producer for producing at least one block of a section of the musical piece;

a line producer for producing at least one musical line; and an output producer for converting the musical piece to an output format.

The at least one generator can comprise a structure generator callable by the section producer, the structure generator for generating the at least one section, such that the section producer produces a linear progression of sections to form a structure of the musical piece. Producing at least one section can comprise producing at least one section according to at least one of length, section number, and section type. The section type can comprise at least one of a regular section and an end section. Producing the at least one block of a section of the musical piece can comprise sequentially producing blocks until the section is of a given length. The at least one generator is callable by the block producer, and can comprise at least one of a harmonic generator for generating a harmonic pattern, a meter generator for generating a meter, and a mode generator for generating a mode. The at least one generator is callable by the line producer and can comprise a motif generator for generating a motif pattern independent of a mode and a harmonic pattern. The line producer can be further enabled to map the motif pattern onto a previously generated harmonic pattern by:

converting the motif pattern to a harmony adjusted motif based on the previously generated harmonic pattern;

bringing each note in the motif pattern into a range of a previously generated mode; and resolving each the note in the motif pattern into at least one of a pitch of the previously generated mode and a nearby dissonant note, based on the harmonic chords in the previously generated harmonic pattern.

The processing unit further can be enabled to convert the musical piece to an output format that is at least one of playable by an output device and storable in a data file. The flexible music composition engine can further comprise the output device, the output device controllable by the processing unit. The output device can be enabled to output the musical piece.

The flexible music composition engine can further comprise a memory for storing the data file.

The processing unit can be further enabled to adjust at least one musical element of the musical piece, such that the musical piece reflects a given emotional character, by:

receiving at least one indication of a given emotional character;

retrieving at least one mood parameter associated with at least one musical element, the at least one mood parameter specifying how the at least one musical element is to be adjusted to reflect the given emotional character;

adjusting the at least one musical element of the music based on the at least one mood parameter.

The processing unit can be further enabled to adjust the at least one musical element by:

receiving at least one weight parameter specifying the degree to which the music is to be adjusted to reflect the given emotional character, wherein the at least one weight parameter can comprise a percentage that the music is to be adjusted to reflect the given emotional character, and wherein the adjusting the at least one mood parameter based on the at least one weight parameter can comprise adjusting the at least one mood parameter based on the percentage; and adjusting the at least one mood parameter based on the at least one weight parameter, prior to the adjusting the at least one musical element.

The flexible music composition engine can further comprise an interface for receiving control data from at least one of a media device and a multimedia application, the interface in communication with the processing unit, such that the processing unit produces the musical piece in real time based on the control data. The media device can comprise at least one of a video device, a videogame device, a telephonic device. The flexible music composition engine can further comprise at least one of the media device and the multimedia application.

A second aspect of the specification provides a method of generating music in real-time, in a computing device including a processing unit, the method executable in the processing unit. The method comprises creating a pipeline for coordinating generation of a musical piece. The method further comprises loading at least one producer into the pipeline, the at least one producer for producing at least one high level musical element of the musical piece, independent of other producers in the pipeline. The method further comprises calling at least one generator, by the at least one producer, the at least one generator for generating at least one low level musical element of the musical piece. The method further comprises integrating the at least one low level musical element and the at least one high level musical element, such that the processing unit produces the musical piece in real time.

A third aspect of the specification provides a system for generating music in real-time. The system comprises a processing unit enabled to create a pipeline for coordinating generation of a musical piece. The processing unit is further enabled to load at least one producer into the pipeline, the at least one producer for producing at least one high level musical element of the musical piece, independent of other producers in the pipeline; The processing unit is further enabled to call at least one generator, by the at least one producer, the at least one generator for generating at least one low level musical element of the musical piece. The processing unit is further enabled to integrate the at least one low level musical element and the at least one high level musical element, such that the processing unit produces the musical piece in real time. The system further comprises at least one output device, in communication with the processing unit, enabled to output the musical piece. The system further comprises at least one media device, in communication with the processing unit, enabled to produce multimedia data and control data, the control data for triggering the processing unit to change a style of the musical piece synchronous with the multimedia data.

BRIEF DESCRIPTIONS OF THE DRAWINGS

Embodiments are described with reference to the following figures, in which.

DETAILED DESCRIPTION OF THE EMBODIMENTS

Figure 1:
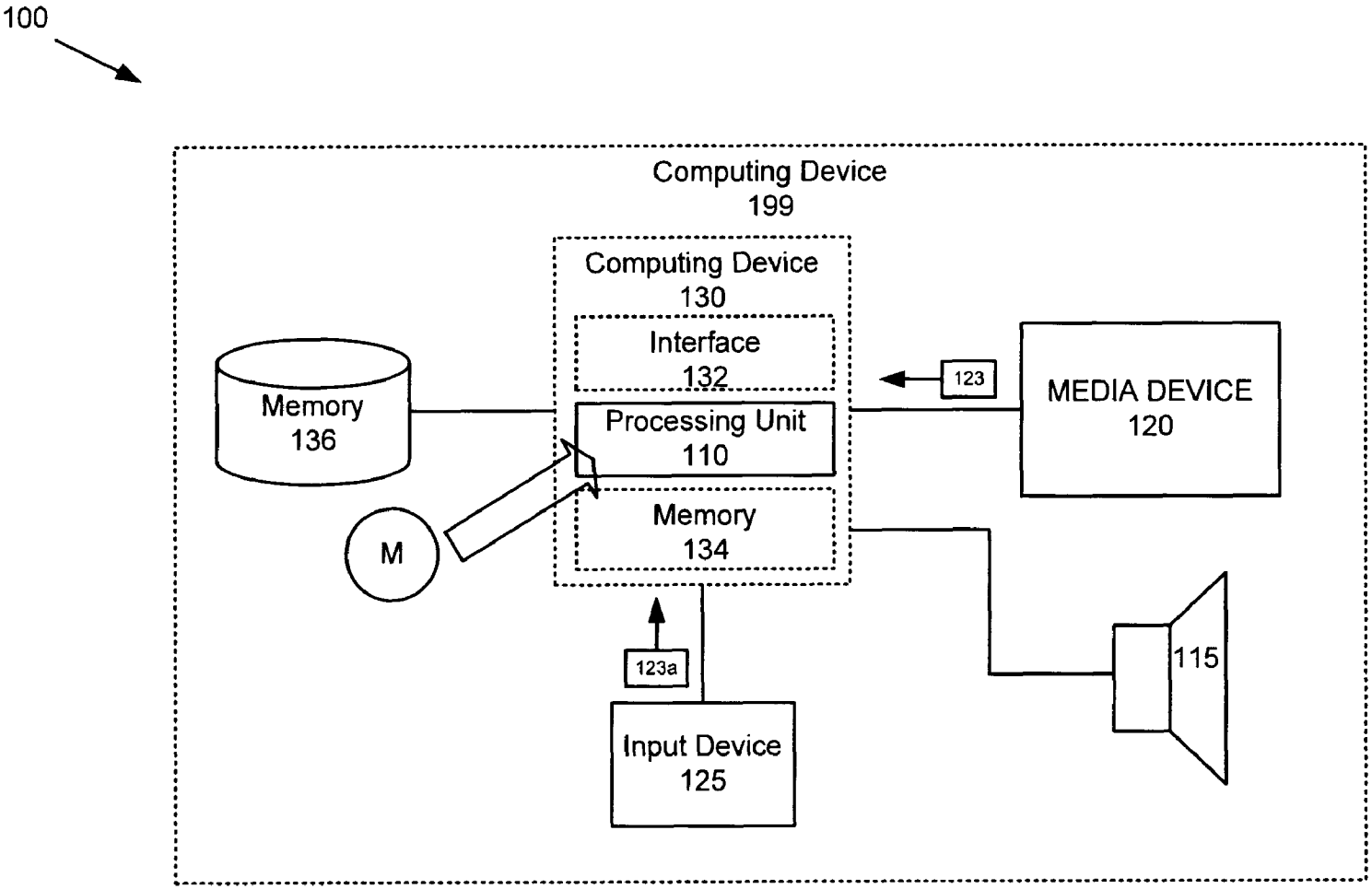
FIG. 1 depicts a system for generating music in real-time, according to non-limiting embodiments.

FIG. 1 depicts a system 100 for generating music in real-time, according to non-limiting embodiments. The system 100 comprises a processing unit 110 for processing an application M, the processing unit 110 in communication with an output device 115. In general, the processing unit 110 is enabled to generate music in real time, in a manner described below, and in turn control the output device 115 to play the music being generated as described below.

The output device 115 generally comprises an audio output device, such as a speaker.

In some embodiments, the processing unit 110 is in communication with a media device 120, and further enabled to receive control data 123 from the media device 120, such that the processing unit 110 generates the music in real time based on the control data 123. For example, the media device can comprise at least one of a video device, a videogame device, and a telephonic device, and can include, but is not limited to, any suitable combination of a processing unit, memory, communication interface, input devices, output devices, etc. As data is generated at the media device 120, the music being generated can be adjusted to reflect the data at the media device 120. In a non-limiting example, if the media device 120 comprises a videogame device, as events occur in a videogame, the music can be generated to reflect the events (e.g. happy music for happy events and sad music for sad events). In another non-limiting example, the media device 120 comprises a telephonic device.

In some embodiments, the processing unit 110 is in communication with an input device 125, and control data 123*a* can be received from the input device 125. Hence a user interacting with the input device 125 can determine the control data 123*a*. The input device 125 can include, but is not limited to, a keyboard, a pointing device, a touch screen, etc.

In some embodiments the processing unit is an element of a computing device 130, the computing device 130 comprising an interface 132 and a memory 134, the interface for receiving the control data 123 and/or control data 123*a*, and the memory 134 for storing the application M until the application M is processed by the processing unit 110. The memory 134 can also store any data used in the processing of the application M, and/or any data generated during the processing of the application M. The computing device 130 can include, but is not limited to, a personal computer, a laptop computer, and a mobile computing device.

The memory 134 can comprise any suitable combination of persistent memory and volatile memory, including but not limited to, any suitable combination of a removable diskette, CD-ROM, ROM, fixed disk, USB drive, hard drive, RAM, etc.

In yet further embodiments, the processing unit 110 is in communication with a memory 136 external to the computing device 130 (e.g. via a communications network, not depicted), the memory 136 for storing the application M until the application M is processed by the processing unit 110. The memory 136 can also store any data used in the processing of the application M, and/or any data generated during the processing of the application M.

In yet further embodiments, the processing unit 110, the output device 115 and the media device 120 can be elements of a computing device 199, with processing for the media device 120 also occurring in the processing unit 110. For example, the computing device 199 can include, but is not limited to, a computer, a laptop computer, a mobile computer, a mobile computing device, video device, a videogame device, and a telephonic device.

In any event, the processing unit 110, upon processing the application M, generally comprises a flexible music composition engine enabled to generate music in real time and/or generate music on demand, for example during game play of a video game, such that the music generated can be influenced by game events and change character on the fly.

Hence, the processing unit 110, in combination with the application M, described hereafter, meets several goals:

(a) Permit flexibility in the composition process. The processing unit 110 can either generate music without any restrictions, or a user (e.g. a human composer) can guide musical choices.

(b) Provide an extensible architecture that can be integrated with other software.

(c) Incorporate a multi-level application programming interface which makes the functionality of the processing unit 110 accessible to users with varying levels of musical and/or programming knowledge.

(d) Reuse musical elements, such as note sequences and harmonic structure, both from existing composed pieces or computer generated material.

(e) Alternatively allow music to be altered based on emotional characteristics such as happiness, sadness, anxiety, liveliness etc.

In some non-limiting embodiments the application M is generally an object-oriented system written in any suitable programming language, including but not limited to C#, C++, and/or Java. It includes high-level classes such as Musician and Instrument that model real-world entities involved in music composition. Furthermore, the application M comprises a pipelined architecture in the generation process to allow a structured, yet flexible approach to composition, the inclusion of optional pattern libraries for storing and accessing musical information, and an optional emotion mapper 240 which allows music to be altered according to emotional characteristics. Each of these will be described below.

Furthermore, the application M can be embedded within application software to facilitate online, dynamic composition of music for immediate use within that application. For example, using the engine in a video game would allow endless variety in the game music, and since composition is done dynamically, the generated music could be tuned to reflect emotional context during game play. Alterations to the music could be initiated from within the game, by the game player, or both. In addition, the application M can be used as a basis for stand-alone composition tools. For example, consider a system which would permit collaboration among human composers who could exchange parts of pieces created with the engine, or share virtual musicians, instruments, and musical elements. the application M's architecture can also support the creation of virtual bands and jam sessions.

Figure 2:
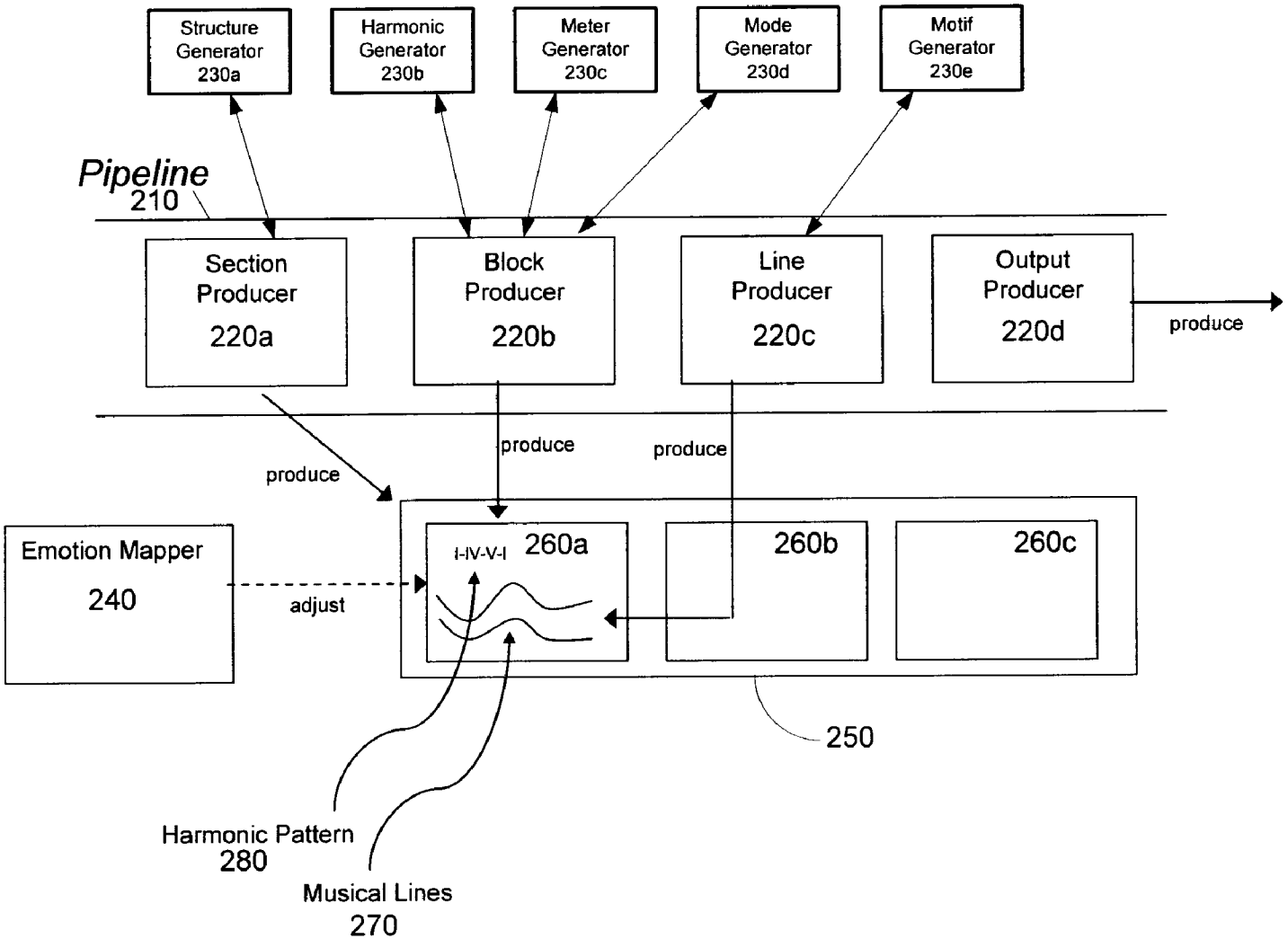
FIG. 2 depicts an architecture of an application for generating music in real-time, according to non-limiting embodiments.

Attention is now directed to FIG. 2, which depicts the architecture of the application M, according to non-limiting embodiments, as well as a block diagram of output from the application M (e.g. a musical piece), which can be used by the processing unit 110 to control the output device 115.

the application M comprises several groups of classes:

A pipeline 210. The pipeline 210 controls the flow of the music generation process, and is responsible for calling methods on the generating classes, described below. In some embodiments, the application M can comprise more than one pipeline, including the pipeline 210.

At least one producer 220, including but not limited to a section producer 220*a*, a block producer 220*b*, a line producer 220*c* and an output producer 220*d*, each of which is described in further detail below (referred to generically as a producer 220, and collectively as producers 220). The producers 220 produce high level musical elements of the musical piece. Non-limiting examples of high level musical elements include, but are not limited to, sections, blocks and musical lines.

At least one generator 230, including but not limited to a structure generator 230*a*, a harmonic generator 230*b*, a meter generator 230*c*, a mode generator 230*d* and a motif generator 230*e* (referred to generically as a generator 230 and collectively as generators 230). The generators 230 are callable by the producers 220, with specific producers 220 calling specific generators 230. For example, the section producer 220*a* calls the structure generator 230*a*, the block producer 220*b* calls the harmonic generator 230*b*, the meter generator 230*c* and the mode generator 230*d*, and the line producer 220*c* calls the motif generator 230*e*. The generators 230 are generally enabled to create low level musical elements (harmonic patterns, motif patterns, modes, and meters) which are integrated with the high level musical elements, to create the musical piece. Generators 230 can have library-based or pseudo-random implementations, as described below.

Figure 3:
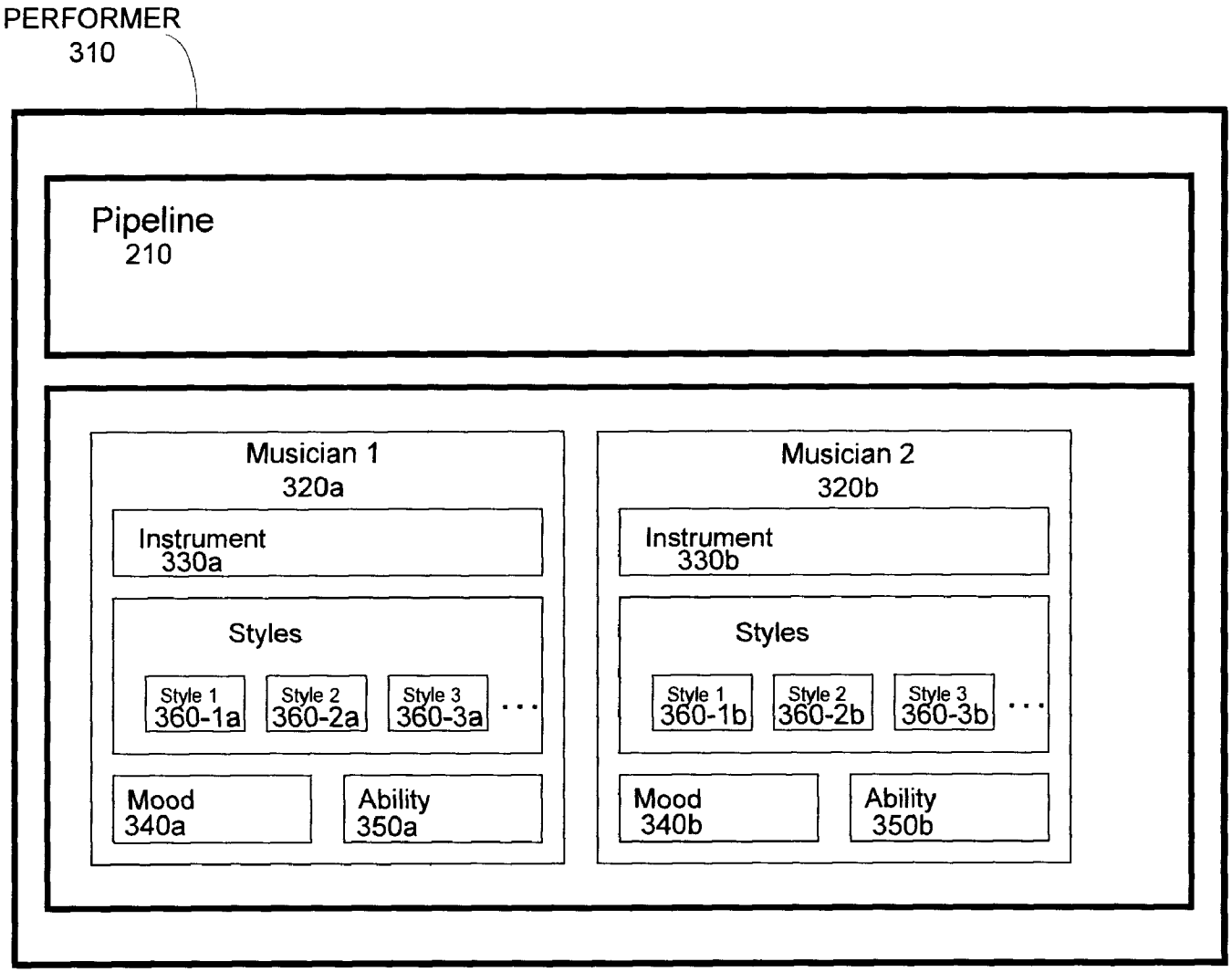
FIG. 3 depicts the architecture of a performer, according to non-limiting embodiments.

Other high-level classes, including but not limited to at least one of Musician, Instrument, Performer, Piece Characteristics, Style, Mode, Meter, and Mood. These classes implement the real-world entities modelled in the application M, as described below. For example, FIG. 3 depicts a non-liming example of a performer 310, which comprises the pipeline 210, a first musician 320*a* and a second musician 320*b* (generically a musician 320 and collectively musicians 320). Each musician 320*a* and 320*b* comprises at least one instrument 330*a* and 330*b*, respectively, a mood 340*a* and 340*b*, respectively and an ability 350*a* and 350*b*, respectively. In addition, in some embodiments each musician 320 can comprise at least one style 360-1, 360-2, 360-3, etc. However, in other embodiments a musician 320 may not comprise any styles 360. In practice, each of the high level classes can comprise data which, when processed by the processing unit 110, causes the processing unit 110 to generate music in accordance with the high-level class, as described below. It is understood that the performer 310 can comprise any suitable number of musicians 320. For example, the performer can comprise a single musician 320 (e.g. a soloist), four musicians 320 (e.g. a quartet), tens or hundreds of musicians 320 (e.g. an orchestra), and further that each musician 320 can be enabled to play the same or different instrument 330, in the same or different style 360, in the same or different mood 340 and with the same or different ability 350. Hence, by changing the number of musicians 320 and the properties of each musician 320, the performer 310 can be customized to any desired number and type of musician 320. In some embodiments, the configuration of the performer 310 and the musician(s) 320 can be controlled via the input device 125 and/or a graphical user interface (not depicted) and/or the media device 120.

Each of the pipeline 210, the producers 220, the generators 230 and the other high-level classes can be stored in the memory 134 and/or the memory 136 until processed by the processing unit 110 and/or called by the appropriate element of the application M (e.g. generators 230 are stored until called by a producer 220).

the application M can also comprise an emotion mapper 240, described below, for adjusting at least one musical element of a musical piece such that the musical piece reflects a given emotional character.

When initiating the system 100, the producers 220 and generators 230 are loaded into the pipeline 210. In some non-limiting embodiments, the producers 220 and generators 230 are created before being loaded into the pipeline 210. In these embodiments, a Generator Factory (not depicted) can be used create the generators 230.

Each of the generators 230 are summarized hereafter:

The structure generator 230*a* is enabled to create the overall sectional structure of a musical piece (e.g. ABA form).

The harmonic generator 230*b* is enabled to create a sequence of chords for each section (e.g. I-IV-V-I) of a musical piece.

The meter generator 230*c* is enabled to create a meter (e.g. 4/4 time) for a musical piece.

The mode generator 230*d* is enabled to create modes for a musical piece (e.g. start in F+, progress to C+, divert to D– and return to F+).

The motif generator 230*e* is enabled to create sequences of notes (e.g. a four note ascending scale of sixteenth notes) for a musical piece.

Each generator 230 can contain at least one random and/or pseudo-random number component which is used for decisions it needs to make.

Each generator 230 can also contain at least one Pattern Library (not depicted) which provides the generator 230 with musical elements it can use directly, or as starting points for musical element generation. Pattern libraries can be created prior to processing the application M, and generally comprise data embodying musical knowledge. For example, a "Bach" MotifPattern library can contain motifs from compositions by Johann Sebastian Bach. Similarly, a "Bach" Harmonic pattern library can contain harmonic patterns from compositions by Johann Sebastian Bach. In some embodiments, pattern libraries can be added to a generator 230, enabling distribution of new pattern libraries after the application M has been installed in a computing device. In yet further embodiments, users and/or the application M can add to the pattern libraries. In some embodiments, the pattern library or libraries can be stored in the memory 134 and/or the memory 136.

Furthermore, in some embodiments, there can be a plurality of each of the generators 230*a*-230*e*, with each group of generators 230*a*-230*e* associated with a different style. For example, in some embodiments such a group can comprise a structure generator 230*a*, a harmonic generator 230*b*, a meter generator 230*c*, a mode generator 230*d* and a motif generator 230*e*, each associated with a "jazz" style, and another group of a structure generator 230*a*, a harmonic generator 230*b*, a meter generator 230*c*, a mode generator 230*d* and a motif generator 230*e*, each associated with a "classical" style.

In some embodiments, a Producer Factory (not depicted) can be used create the producers 220.

Each of the producers 220 are summarized hereafter, with reference to FIG. 2:

The section producer 220*a* is enabled to use (e.g. call) the structure generator 230*a* to produce at least one section 250, the section 250 comprising a chunk of a musical piece with an associated length, for example in seconds. Each section 250 contains a number of blocks 260, which comprise segments of the piece (for example, 4 bars) composed of a musical line played by each musician 320.

The block producer 220*b* is enabled for producing at least one block 260 of a section 250 of the musical piece using a harmonic pattern 280 created by the harmonic generator 230*b*, when the harmonic generator 230*b* is called by the block producer 220*b*. The block producer 220*b* is further enabled to call each of the meter generator 230*c* and the mode generator 230*d* to produce a meter and a mode, respectively, for the block 260.

The line producer 220*c* is enabled to produce the musical lines 270 using the motif generator 230*e* to create the actual note sequences in musical lines 270 played by each musician 320. In some embodiments, the line producer 220*c* is enabled to produce musical lines with varied articulation (e.g. staccato vs. legato playing), or any other articulation known to a person of skill in the art.

The output producer 220*d* is enabled to convert the musical piece to any suitable output format, including but not limited to MIDI, way, mp3 and/or streamed formats. Furthermore, the output producer 220*b* can be enabled to store an output data file (e.g. in the memory 134 and/or the memory 136) comprising the musical piece and/or output the musical piece to the output device 115.

It is understood that while each of the producers 220, the generators 230 etc., are described with respect to given functionality, the processing unit 110 performs the associated functionality upon processing of each producer 220 and generator 230.

Figure 9:
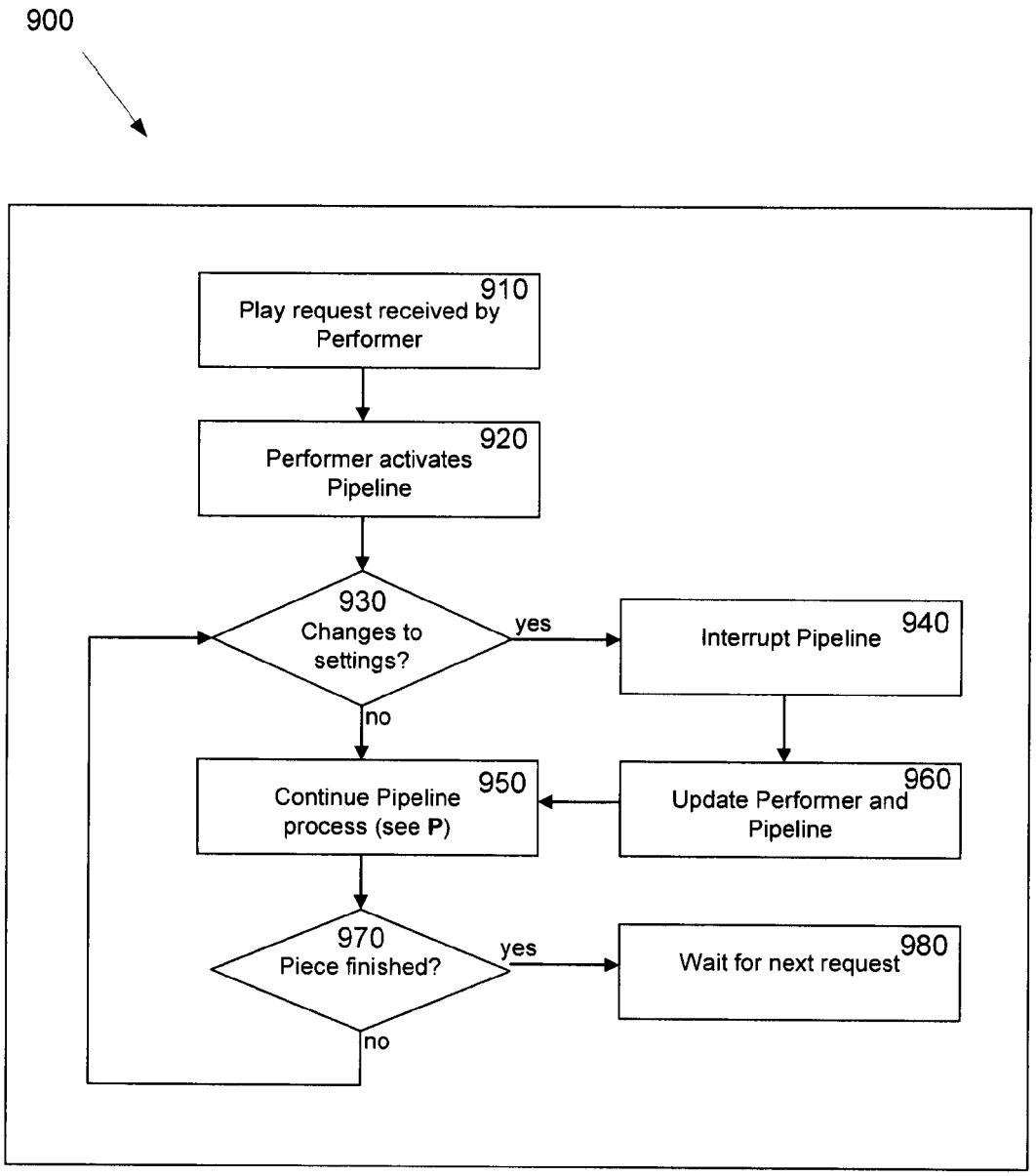
FIG. 9 depicts a method for generating music in real-time, according to non-limiting embodiments.

Attention is now directed to FIG. 9 which depicts a method 900 for generating music in real-time, according to non-limiting embodiments. In order to assist in the explanation of the method 900, it will be assumed that the method 900 is performed using the system 100 using the architecture of the application M depicted in FIG. 2. Furthermore, the following discussion of the method 900 will lead to a further understanding of the system 100 and the architecture of FIG. 2, and their various components. However, it is to be understood that the system 100 and/or the architecture of FIG. 2 and/or the method 900 can be varied, and need not work exactly as discussed herein in conjunction with each other, and that such variations are within the scope of present embodiments.

At step 910, a play request is received by the performer 310, for example by the processing unit 110 upon processing the application M. Furthermore, it is understood that the performer 310 has been pre-configured to initiate with a given number of musicians 320, each with the pre-configured properties, as described above, though as will be described the number of musicians 320 and/or their properties can be changed such that musical piece being generated changes accordingly in real time. In some embodiments, the performer 310 can further receive a given style, which is subsequently passed to each of the producers 220 in the pipeline 210, such that each producer 220 can call generators 230 associated with the given style.

At step 920, the performer 310 activates the pipeline 210 based on settings such as pre-configured settings and/or the given style and/or the control data 123 or 123*a*. At step 930, it is determined if there any changes to the settings: for example, pre-configured settings may be changed to a new configuration via the input device 125, the given style may change to a new style, and/or the control data 123 or 123*a* may indicate that settings have changed (e.g. new style, different events occurring at the media device 120, such as new events in a video game).

If no changes to the settings have occurred (for example, as will be the case when processing unit 110 first processes the application M), then a pipeline process P is initiated and/or continues at step 950, the pipeline process P described below. In general, however, the pipeline process P is enabled to generate sections and/or blocks of the musical piece.

If however, it is determined at step 930 that changes to the settings have occurred, then at step 940 the pipeline process P is interrupted and at step 960 the performer 310 and the pipeline 210 are updated such that the musical piece is now generated according to the new settings. In a non-limiting example, game play in a videogame may become more intense or less intense, and the emotional characteristics of the musical piece can be adjusted accordingly, and/or the tempo or style of the musical piece can be adjusted accordingly. In another non-limiting example, a user interacting with the processing unit 110 via the input device 125 can add or subtract musicians 320, change style, mood, instruments etc.

Once the performer 310 and the pipeline 210 are updated, the pipeline process continues at step 950. At step 970 it is determined if the musical piece is complete, based on the pre-configured settings and/or the control data 123 or 123*a*. For example, the pre-configured settings may indicate that the musical piece is to be of a given length and/or a given number of sections. If the musical piece is finished, the processing unit 110 waits for a new play request at step 980. If the musical piece is not finished, steps 930-970 are repeated to continue to generate the musical piece.

Figure 4:
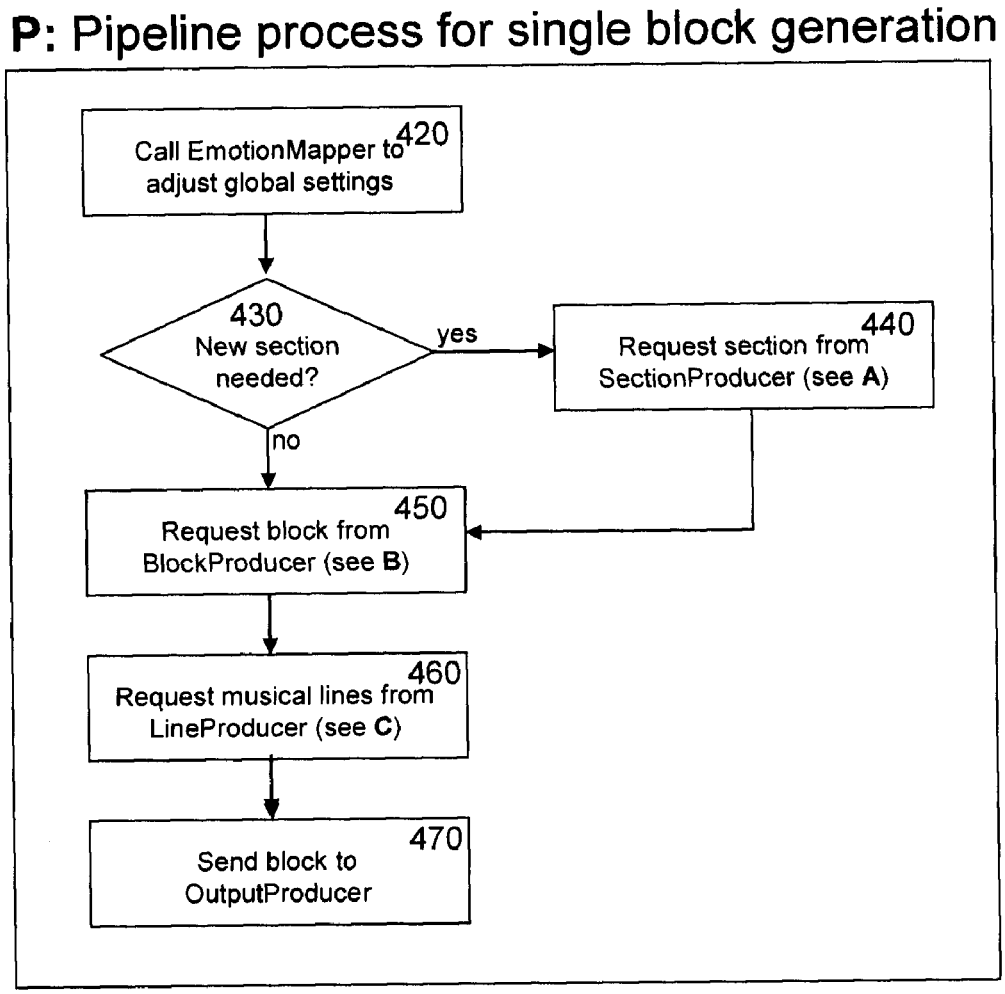
FIG. 4 depicts a pipeline process, according to non-limiting embodiments.

Attention is now directed to FIG. 4, which depicts the pipeline process P, according to a non-limiting embodiment. At an optional step 420 the emotion mapper 240 can be called to adjust global settings (e.g. musical characteristics that are not changed elsewhere, such as tempo, volume etc.).

Figure 5:
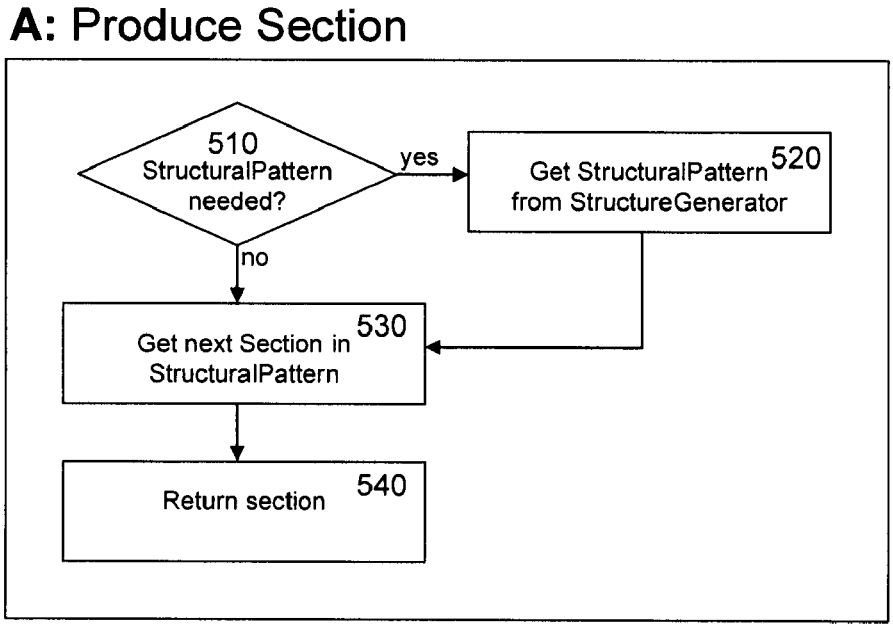
FIG. 5 depicts a method for producing a section, according to non-limiting embodiments.

At step 430, it is determined if a new section 250 is needed. If the application M is being initialized then by default at least one new section 250 is needed. If a new section 250 is needed, at step 440 the section 250 is requested from the section producer 220*a*, in a method "A" depicted in FIG. 5. Turning to "A" in FIG. 5, it is determined if a structural pattern is needed. If so, at step 520 the section producer 220*a* calls the structure generator 230*a*, which provides a structural pattern. In any event, at step 530, the section producer 220*a* gets a new and/or the next section 250 in the structural pattern. The length of each section 250 can be determined via control data 123 or control data 123*a*, which can be passed to or retrieved by the structure generator 230*a*. At step 540, the new section 250 is returned to pipeline 210 (e.g. in step 440 in "P" of FIG. 4).

Figure 6:
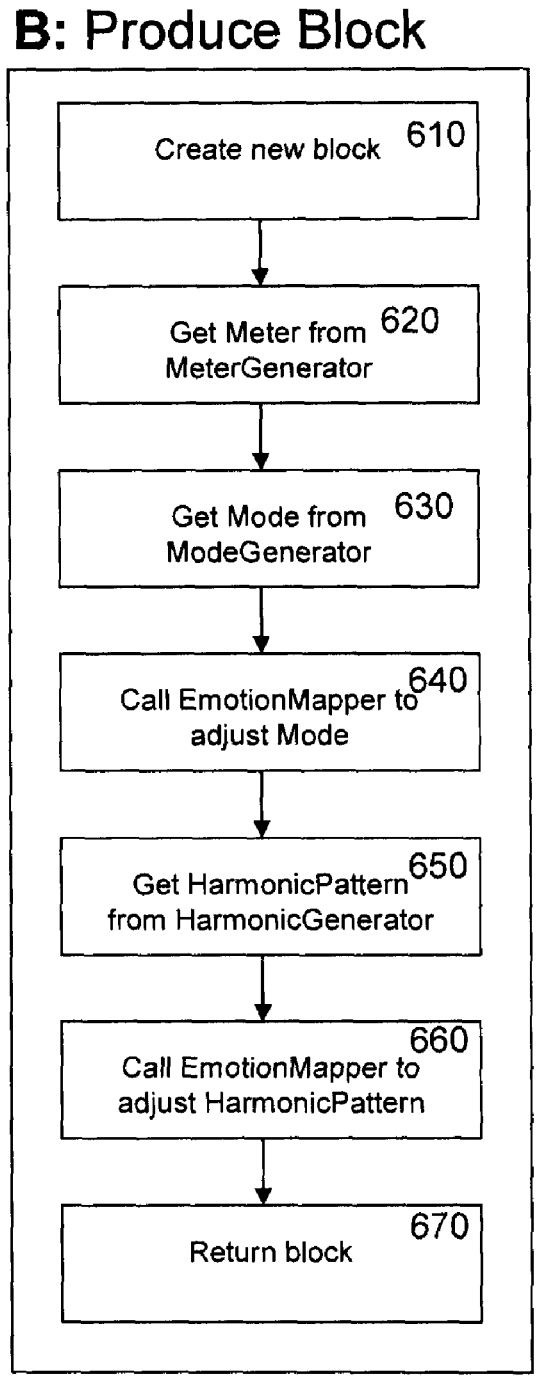
FIG. 6 depicts a method for producing a block, according to non-limiting embodiments.

Returning to FIG. 4, if no section is needed at step 430 (or alternatively, once the new section is returned at step 540), at step 450, a block 260 is requested from the block producer 220*b* in a method "B" depicted in FIG. 6. Turning to "B" in FIG. 6, at step 610 a new block is created of a given pre-configured and/or randomly and/or pseudo-randomly determined length (for example 4 bars). At step 620, the block producer 220*b* gets a meter by calling the meter generator 230*c*, and at step 630 the block producer 220*b* gets a mode by calling the mode generator 230*d*. A meter and mode, respectively, are subsequently returned based on pre-configured settings and/or the given style and/or the control data 123 or 123*a*.

At an optional step 640, the emotion mapper 240 can adjust the mode according to pre-configured settings and/or the given style and/or the control data 123 or 123*a*.

At step 650, the block producer 220*b* gets a harmonic pattern by calling the harmonic generator 230*b*. A harmonic pattern is subsequently returned based on pre-configured settings and/or the given style and/or the control data 123 or 123*a*. At an optional step 660, the emotion mapper 240 can adjust the harmonic pattern according to pre-configured settings and/or the given style and/or the control data 123 or 123*a*.

At step 670 the block 250 is assembled and returned to the pipeline 210 (i.e. in step 450 in "P" of FIG. 4).

Figure 7:
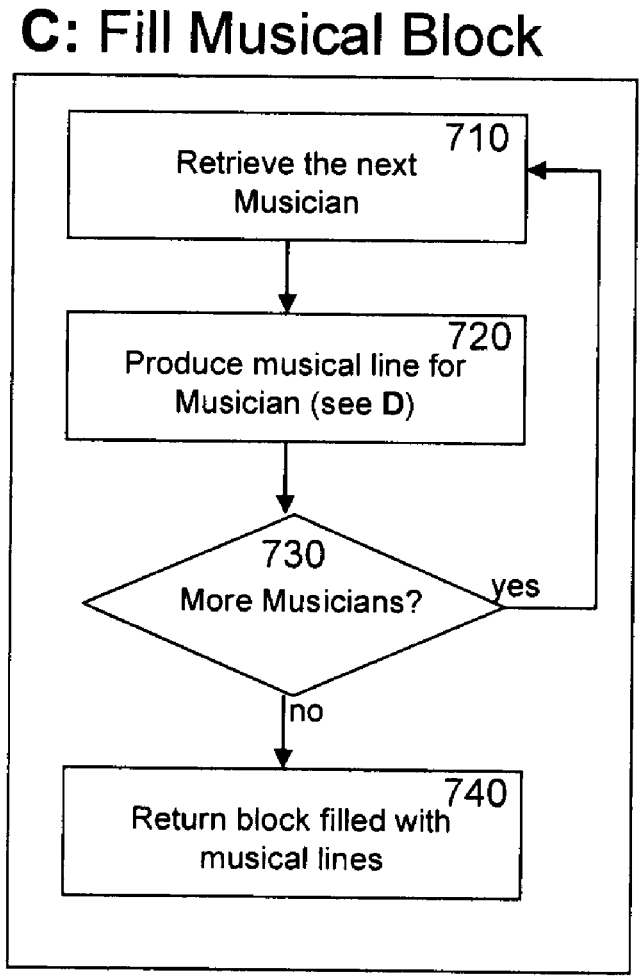
FIG. 7 depicts a method for filling a block, according to non-limiting embodiments.

Returning again, to FIG. 4 at step 460 the musical line 270 (or a plurality of musical lines 270 according to the number of musicians 320 in the performer 310) is requested from the line producer 220*c*, in a method "C" depicted in FIG. 7. Turning to "C" in FIG. 7, at step 710 a musician 320 is retrieved by the line producer 220*c* (i.e. the data representing an instrument 330, a mood 340, an ability 350 and a style 360 associated with a musician 320 is retrieved). At step 720 the line producer 220*c* calls a routine "D" (or "Produce Musical Line") to produce the musical line 270 for the retrieved musician 320, the routine D described below. At step 730, it is determined if there are more musicians 320 for which a musical line 270 is to be produced. If so, the next musician 320 is retrieved at step 710. If not, the block 260 is assembled and returned at step 740 to the pipeline 210 (i.e. in step 460 in "P" of FIG. 4), the block 260 now populated with the musical line(s) 270.

Figure 8:
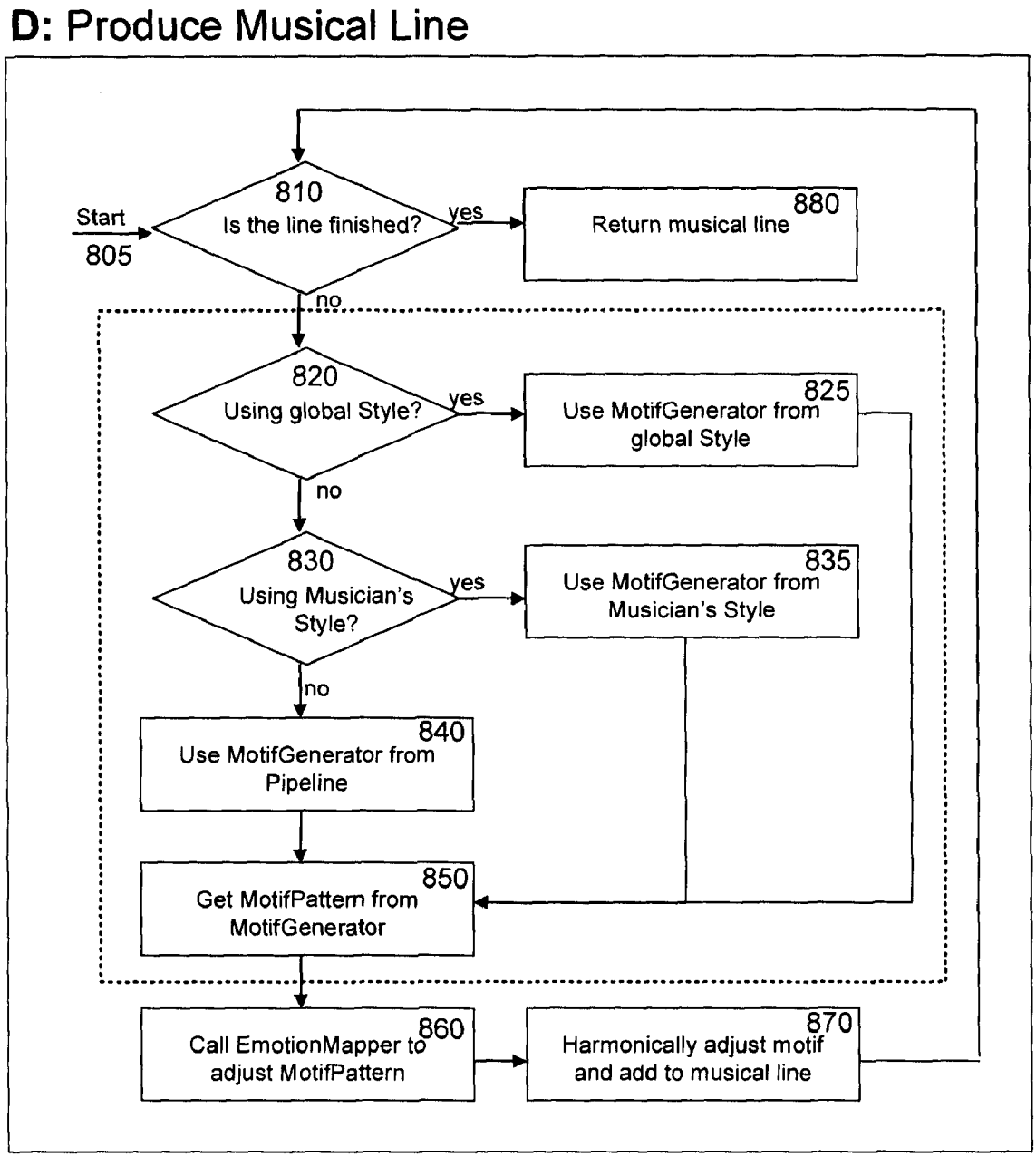
FIG. 8 depicts a method for producing a musical line, according to non-limiting embodiments.

Attention is now directed to FIG. 8, which depicts the routine "D" for producing the musical line(s) 270. The routine starts at step 810 where it is determined if the musical line 270 being produced is finished. If not (e.g. the routine D is initializing or the length of the block has not been reached), then at steps 820 to 840, the style of the motif to be returned is determined, based on pre-configured settings and/or the given style and/or the control data 123 or 123*a*. At step 820 it is determined if a global style (e.g. the given style) is to be used. If so, at step 825, the motif generator 230*e* associated with the global style (i.e. the given style) is selected. If not, at step 830 it is determined if the style of a musician 320 (e.g. a style 360) is to be used. If so, at step 835, the motif generator 230*e* associated with the style of the musician 320 is selected. If not, at step 840, the motif generator 230*e* associated with a default style associated with the performer 310 and/or the pipeline 210 is selected. In any event, once the appropriate motif generator 230*e* has been selected, at step 850 the motif pattern is returned from the appropriate motif generator 230*e*.

Indeed, steps similar to steps 820-850 can be repeated when any producer 220 makes a call to a generator 230 based on style. For example, in steps 520, 620, 630 and 650, calls to the appropriate generator 230 can be determined via decisions similar to those made in step 820 and 830.

At an optional step 860, the emotion mapper 240 can adjust the motif according to pre-configured settings and/or the given style and/or the control data 123 or 123*a*.

At 870, the motif is harmonically adjusted and added to the musical line 870 (described below). At 810 it is again determined if the musical line 270 is finished (i.e. the length of the block has been reached). If not, step 820-870 are repeated and, if so, at step 880, the musical line is returned to the pipeline 210 (i.e. in step 720 in "C" of FIG. 7).

Attention is again directed to FIG. 4, where once the musical line(s) 270 have been returned, at step 470 the output producer 220*d* generates output data. The output data can be saved to a file (i.e. in the memory 134 and/or the memory 136) or used to control the output device 115 to play the musical piece that has been generated.

Returning again to FIG. 9, it is understood that the application M monitors the settings through all of the steps depicted in FIGS. 4-9, and adjusts the generation of the musical piece accordingly. In other words steps 930-960 can occur before, during or after any of the steps depicted in FIGS. 4-9, such that the pipeline process P is interruptible at step 940 at any appropriate step depicted in FIGS. 4-9, such that the performer 310 and the pipeline 210 can be updated at step 960. In some embodiments, the interruption of the pipeline process P can be delayed if interruption of the pipeline process P results in a discontinuity in the generation of the musical piece (e.g. a dead space where no dead space is desired).

In some embodiments the musical piece is updated between blocks 260. However, as in some embodiments, music generation can occur much more quickly than playback (i.e. by the output device 115), and thus, many blocks 260 can be generated while the first block 260 is playing. Hence, to support dynamic alteration of the musical piece, some of these embodiments comprise a means of keeping track of which block 260 is currently being played, a means of altering and/or replacing subsequent blocks 260 when a change to a setting occurs.

Furthermore, in other embodiments, alterations can occur gradually rather than abruptly and/or sometimes gradually and sometimes abruptly. In embodiments where gradual change occurs, parameters for starting and end points of the transition are determined and blocks 260 in between are generated accordingly. In these embodiments, present and future parameters are tracked.

Figure 10:
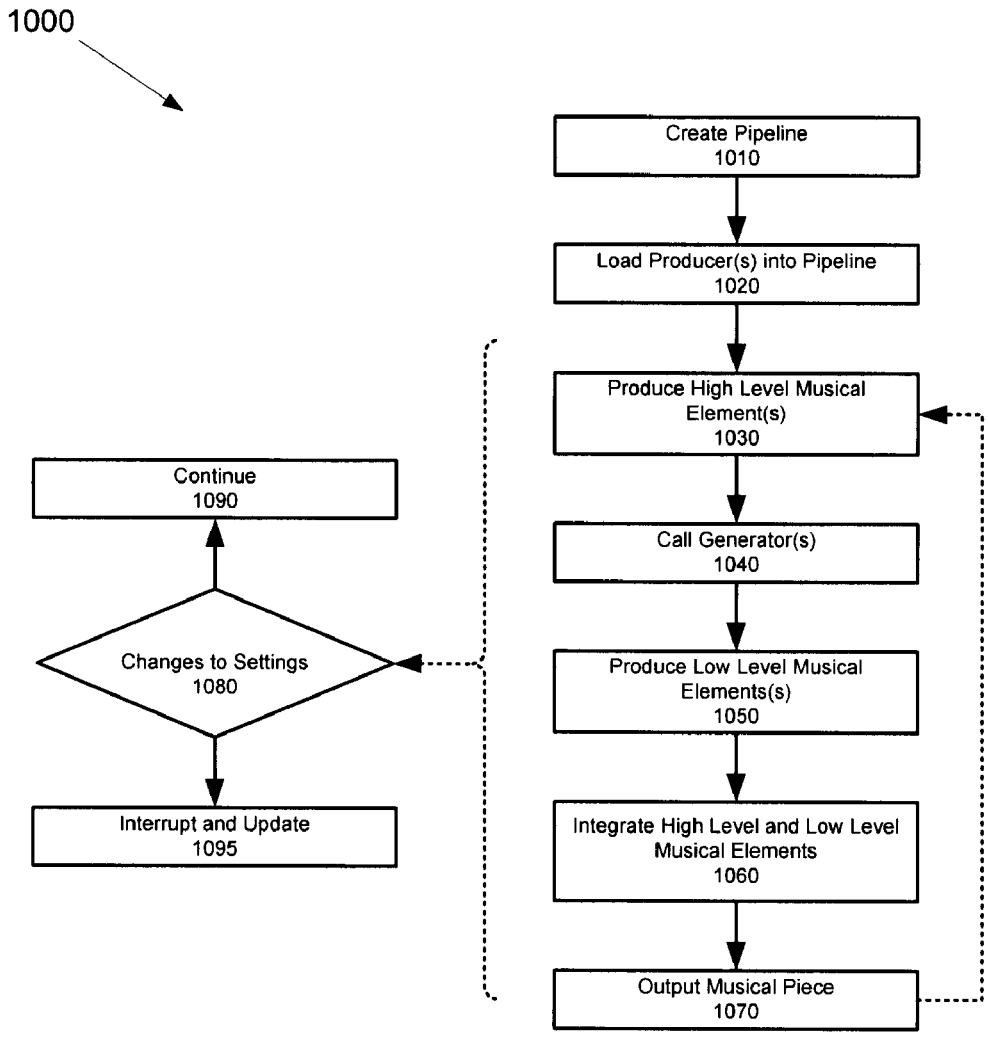
FIG. 10 depicts a method for generating music in real-time, according to non-limiting embodiments.

Attention is now directed to FIG. 10 which depicts a method 1000 for generating music in real-time. In order to assist in the explanation of the method 1000, it will be assumed that the method 1000 is performed using the system 100 using the architecture of the application M depicted in FIG. 2. Furthermore, the following discussion of the method 1000 will lead to a further understanding of the system 100 and the architecture of FIG. 2, and their various components. However, it is to be understood that the system 100 and/or the architecture of FIG. 2 and/or the method 1000 can be varied, and need not work exactly as discussed herein in conjunction with each other, and that such variations are within the scope of present embodiments. In some embodiments, the method 1000 is a summary of the methods, processes and routines of FIGS. 4-9. It is hence understood that method 1000 is generally performed by the processing device 110.

At step 1010 the pipeline 210 is created. In a non-limiting embodiment, the pipeline 210 is created by the performer 310, but in other embodiments the pipeline 210 may be created by another entity.

At step 1020, at least one producer 220 is loaded into the pipeline 210, the at least one producer 220 for producing at least one high level musical element of the musical piece, independent of other producers 220 in the pipeline. Non-limiting examples of a high level musical element include, but are not limited to, sections 250, blocks 260 and musical lines 270.

At step 1030, the high level musical elements are produced by the at least one producer 220.

At step 1040, at least one generator 230 is called within the at least one producer 220, the at least one generator 230 for generating at least one low level musical element of the musical piece. Non-limiting examples of a low level musical elements include, but are not limited to structure, meter, mode, harmonic pattern, and motif pattern.

At step 1050, the low level musical elements are produced by the at least one generator 230.

At step 1060, the at least one low level musical element and the at least one high level musical element are integrated, for example by the processing unit 110, such that the musical piece is produced in real time.

At step 1070, the musical piece is output, for example to an output file and/or to the output device 115.

It is understood that steps 1030-1070 can be repeated and/or interleaved as desired. Hence, new high level elements can be produced before or after the low level elements, the new high level elements to be integrated with new low level elements. Further, blocks 260 (and/or sections 250) can be output as they are produced, before or after new high level elements are produced and/or new low level elements are produced and/or integrated with the new high level elements.

Furthermore, steps 1030-1070 can be repeated as required to continue generation of the musical piece, until the musical piece of a given length, or the method 1000 is interrupted. Furthermore, it is understood that due to the pipeline architecture, steps 1030-1070 could occur in parallel.

Furthermore, while steps 1030-1070 are being executed by the processing device 110, settings for the high level and low level musical elements are being monitored to determine a change to the settings, for example at step 1080. If no change is detected, the method 1000 continues at step 1090. If, however, a change to the settings is detected at step 1080, at step 1095 the method 1000 is interrupted at any suitable point to update the pipeline 210 and/or performer 310. In effect, the method 1000 then returns either to step 1030 such that new high level elements can be produced, or to step 1040 (or step 1050), such that new low level elements can be produced. Hence, the musical piece can be changed in real-time, "on the fly".

In other words, within the system 100, once the producers 220 have been initialized, they are loaded into the pipeline 210, which oversees the generation process and calls on each producer 220 in turn to assemble the piece.

Furthermore, at step 1050, if desired, the emotion mapper 240 can be used to adjust the low level musical elements for mood dependent adjustments.

Various aspects of the application M will now be described with reference to FIGS. 1-3.

The elements of the application M that are involved in music creation generally reflect real-life counterparts. At the highest level, the application M deals with the following classes: musician 320, Instrument 330, Performer 310, various piece characteristics, style, mode, meter, and mood 340.

Musicians

A musician 320 plays an instrument 330 and has a mood 340. Also, a musician 320 has an ability 350, and knows a number of styles 360. The intention is to model a real musician, who can play one instrument at a time, but has the ability to play that instrument in different styles with varying ability Consider a pianist who is classically trained, but also plays some improvisational jazz. This pianist can be modelled as a musician 320 who knows (at least) three styles 360: classical, jazz and her own style 360—a personal repertoire of improvisational riffs.

Furthermore, storing an ability 350 for the musician 320 enables modelling of "good" and "bad" musicians 320: Further aspects of ability 350 can be: ability 350 to play an instrument 330 in tune; ability 350 to follow a beat; ability 350 to contain a mood 340 and play in the manner desired by a conductor. The styles 360 "known" by a musician 320 can also reflect ability 350. On the other hand, it may be desired to model a musician with limited ability—perhaps in a video game role (imagine a bar scene where a bad band is playing). It may also be desired to create an application where one has to "train" musicians, or one might want "bad" musicians simply for the entertainment value of hearing them play.

By modelling musicians in this manner, users can develop and trade musicians 320 with one another. For example users can have collections of musicians 320 each with their own skill set. The musicians 320 can be shared, traded, combined into groups, and marketed.

Pattern Libraries

The use of pattern libraries accessible by the generators 230 enables new music to be generated by reusing compositional elements: either elements from existing pieces or elements which have been previously generated. A pattern library can be thought of as a repository of musical ideas. The four libraries which can be used by the application M include, but are not limited to, a harmonic pattern library, a motif pattern library, a mode pattern library and a meter pattern library. Furthermore, the pattern libraries enable the system 100 to compose in different styles, and to provide a mechanism for exchanging and storing musical ideas. Each of these goals will be discussed in turn.

To answer the question, "What style is this piece of music?" a person of skill in the art would listen for clues among the musical elements of the piece to determine its classification. The instruments being played are often an initial hint (the "sound" of the piece). Further to that, attention would be paid to the rhythmic structure, the harmony, the melody, the mode and the meter, and transitions between elements. Consider the knowledge of a jazz trumpet player, for instance Louis Armstrong. He knows typical harmonic progressions that will be used in a piece, and has many "riffs" in mind that he can use and improvise on. In embodiments of the application M, this knowledge can be captured in the harmonic library and motif library respectively.

How the pattern libraries are used can be determined by the implementation of the generators 230. In some embodiments, a generator 230 could use the pattern libraries as its only compositional resource, that is, all the musical elements returned by the generator 230 are those taken from the library. In other embodiments, the generator 230 could use patterns from the pattern libraries as starting points which are then modified. In yet further embodiments, a generator 230 could return a mixture of patterns from the pattern libraries and generated patterns. In yet other embodiments, a generator 230 could ignore the pattern libraries entirely and return only generated patterns. Thus the pattern libraries comprise rich musical resources which can be flexibly used depending on the desired musical outcome.

Regarding the exchange of musical ideas, consider a situation where you meet someone using the application M who has a musician 320 that is very dynamic guitar player (let us call the musician 320 in this instance "Jesse Cook"). The knowledge of the guitar player is contained in his known styles 360, which comprise pattern libraries and generators 230 the guitar player can use for music composition. A musician 320 called Louis Armstrong could to learn how to make his trumpet sound like a flamenco guitar by incorporating the riffs from Jesse Cook's motif library into Louis Armstrong's existing motif library. Another different possibility is that Jesse Cook could be added to a band (e.g. a performer 310 comprising a plurality of musicians 320). A further possibility is that the two musicians 320, Jesse Cook and Louis Armstrong, could jam together. Or, you could ask Jesse Cook and Louis Armstrong to collaborate in an Ensemble (e.g. another performer 310 comprising a plurality of musicians 320). Could they influence each other while playing? All of these functions are supported by pattern libraries as repositories of musical knowledge.

Furthermore, in some embodiments, more than one type of pattern library can be used by and/or loaded into the generators 230, such that sources from more than one style can be combined in the same musical piece. Further, in these embodiments, a user can try pattern library combinations without having to make any changes to the pattern libraries themselves.

In other embodiments, musicians 320 can be enabled to use their own pattern libraries, rather than a common pattern library determined by the generator 230.

In yet further embodiments, pattern libraries can be added and/or modified during composition, enabling repetition in a musical piece, and reuse of motifs in future compositions.

The Pipeline Architecture

The pipeline 210 architecture described with reference to FIGS. 2-10 enables features of real-time music generation which are difficult to achieve in the prior art. The music generation process within the pipeline 210 can be pictured as an assembly line for constructing musical blocks. Each of the producers 220 along the pipeline 210 fills in the elements its generators 230 create, until the finished block 260 is eventually passed to the output producer 220*d* for playback. The producers 220 all work independently, which means the generation process can be parallelized. Furthermore, to dynamically alter a composition, a different generator 230 can be substituted in a producer 220 without affecting the rest of the pipeline 210 (e.g. when a style and/or setting changes).

The Emotion Mapper

Another feature of the application M is the incorporation of mood as a factor which can affect music generation. Mood is considered in two contexts: individual musicians 320 have a mood 340 which can be adjusted independently of other musicians 320, and a piece can have a mood. For example, imagine an orchestra with 27 members. Suppose that the bassoon player is depressed because she just learned that she can no longer afford her car payments on her musician's salary. Suppose that the orchestra conductor is trying to achieve a "happy" sound at the end of the piece currently being played. Depending on how professional the bassoon player is, she will play in a way which reflects her own "sad" mood 340, and the desired "happy" mood 340 to varying degrees.

The emotion mapper 240 is an implementation of a class which makes adjustments to musical elements based, for example, on the emotions "happy" and "sad", though in other embodiments, adjustments to musical elements can be based on other emotions. The emotion mapper 240 can be configured to adjust musical characteristics such as the mode, motif pattern/pitch and tempo etc. The logic behind the emotion-based changes can be based on research in music psychology.

In some embodiments, all mood adjustments can be made based on the mood characteristics of the first musician 320 in a performer 310 or based on a global mood setting. In other embodiments, mood adjustments can be made based on the mood 340 of each musician 320 in a performer 310. However, in these embodiments, some characteristics of a musical piece may be adjusted independent of each mood 340 of a musician 320. For example, mood can affect tempo of the piece, however it may be desired that tempo be constant for all musicians 320. In other embodiments, interesting musical results may occur if musicians 320 play at different tempos depending on their mood 340.

In some non-limiting embodiments, while the mood class contains a plurality of emotional descriptors, the emotion mapper 240 alters music based on a subset of the plurality of emotional descriptors. For example, in some embodiments, the emotion mapper 240 alters music based on the emotions "happy" and "sad". However, it is understood that the emotion mapper 240 can be configured to alter music based on any suitable subset. It is also understood that the emotion mapper 240 can be updated to include further emotional descriptors and/or updated if understanding changes on how emotions translate into changes to musical elements.

In some non-limiting embodiments, the emotion mapper 240 adjusts at least one musical element of the musical piece such that the musical piece reflects a given emotional characteristic by: the receiving at least one weight parameter specifying the degree to which the music is to be adjusted to reflect the given emotional character, wherein the at least one weight parameter comprises a percentage that the music is to be adjusted to reflect the given emotional character, and wherein the adjusting the at least one mood parameter based on the at least one weight parameter comprises adjusting the at least one mood parameter based on the percentage. For example the weight parameters can be received from the media device 120 and/or the input device 125 via the control data 123 and 123*a*, respectively. The emotion mapper 240 then adjusts the at least one musical element based on the at least one mood parameter.

The Motif Generator

The motif generator 230*e* is enabled to generate sequences of notes and rests with associated timing, independent of both mode and harmony. This is best illustrated by a non-limiting example, described hereafter.

Figure 11:
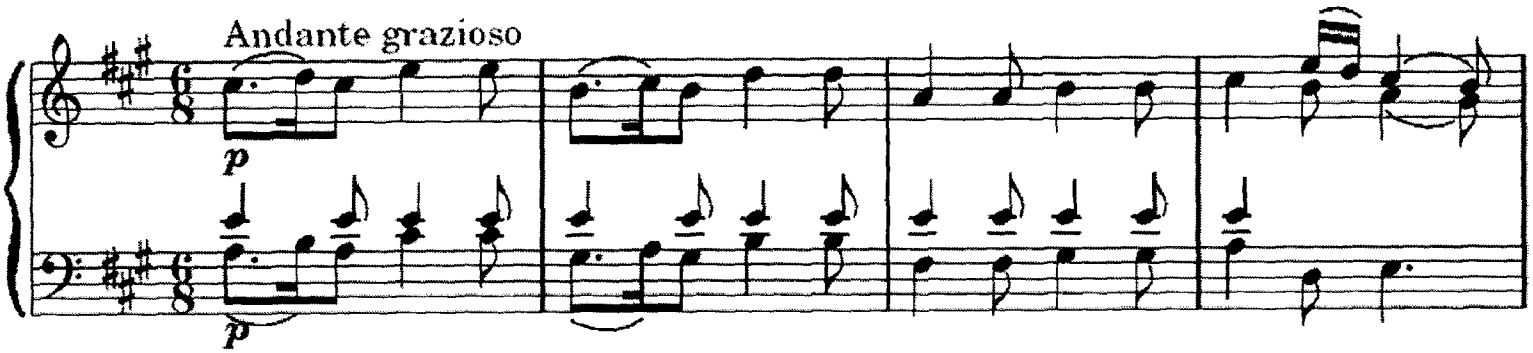
FIG. 11 depicts the opening phrase of Mozart's Sonata in A+, K.331.

Consider the opening phrase of Mozart's Sonata in A+, K.331, as depicted in FIG. 11. A person of skill in the art would understand that the right hand melody in the first bar begins on $C^{\#}$, the third of the scale, and is played over the tonic chord in root position in the bass (harmony I). In the second bar, in the left hand part, we see the exact same melodic pattern, this time starting on $G^{\#}$, played over the dominant chord in first inversion (harmony $V^6$).

In a motif, we would encode this musical idea as:

| | | | | | |
|---|---|---|---|---|---|
| Pitches: | 2 | 3 | 2 | 4 | 4 |
| Locations: | 0.0 | 1.5 | 2.0 | 3.0 | 5.0 |
| Durations: | 1.5 | 0.5 | 1.0 | 2.0 | 1.0 |

Table 1, Example of a Motif Encoded Independent of Mode and Harmony.

Within Table 1, "Pitches" are positions in the mode relative to the root of the harmonic chord (with the root as 0), "Locations" indicate an offset from the beginning of the bar (location 0.0), and "Durations" specify the length of the note. Locations and durations are expressed in terms of number of beats (for example, in 6/8 time, an eighth note is one beat).

Encoding motifs in this manner enables capturing a musical pattern associated with a sequence of notes, without restriction to a specific mode or harmonic chord, and further enables composed pieces and/or musical lines to be transposed and reinterpreted in any mode. Moreover, as illustrated in the above example, a particular pattern of notes often appears more than once during a piece, but serves a different function depending on the underlying harmony.

In some embodiments, the motif generator 230*e* can operate in at least one of a pattern library-based mode and pseudo-random mode (described below). Hence, when a motif is requested (e.g. by the line producer 220*c*), the motif generator 230*e* first checks whether a pattern library has been loaded. If it has, the motif generator 230*e* attempts to retrieve a motif of a specified and/or randomly and/or pseudo-randomly determined length (e.g. a given number of beats), and a desired type (e.g. an end pattern, which is one that could be found at the end of a section 250, or regular pattern, which is one that could be found elsewhere in a section 250, or either). If any suitable patterns are found, they are returned. Otherwise, a new pattern will be generated randomly and/or pseudo-randomly.

Any suitable method of randomly generating motifs may be used in motif creation. In some non-limiting embodiments, two random generators and/or pseudo-random generators may be used, including but not limited to a number generator and a pitch generator. A loop continues generating notes/rests as long as the desired number of beats has not been filled. The motifs are generated according to musically plausible rules and probabilities, which may be stored in the memory 134 and/or the memory 136.

In some embodiments, a pseudo-random number generator may be used to generate motifs. Indeed, as pseudo-random number generators are deterministic, if the motif generator 230*e* is initialized with the same seed values during two different runs, the motifs produced will be exactly the same.

Indeed, it is understood that any of the musical elements, generated by any of the generators 230, may be generated using either a pattern library, or randomly and/or pseudo-randomly, the latter generated using a pseudo-random number generator. Non-limiting examples of a pseudo-random number generator include, but are not limited to, a Mersenne Twister, a Blum Blum Shub, an inversive congruential generator, ISAAC (cipher), Lagged Fibonacci generator, Linear congruential generator, Linear feedback shift register, and Multiply-with-carry. Other pseudo-random number generators will occur to persons of skill in the art and are within the scope of present embodiments.

Use of a pseudo-random number generator further enables checkpointing of the pipeline 210 during music generation so that musical elements can be saved and repeated.

As previously mentioned, the motif is encoded in a mode-independent and harmony-independent manner. Thus, the "pitches" that are generated and stored are actually relative pitches to the root of the harmonic chord in a mode. Consider the following non-limiting example: Suppose the motif contains the pitches values 0-1-0. If that motif is eventually resolved in a position where it appears as part of the I chord in C+, would be resolved to the actual pitches for C-D-C. However, if that same motif were used in a position where the harmony required the V chord in C+, the motif would now be resolved to G-A-G. Suppose now that the motif contains the pitch values 0-0.5-1-0. The value "0.5" indicates that a note between the first and second tone should be sounded, if it exists (this will produce a dissonance). Thus, in C+ for chord I, 0-0.5-1-0 would be resolved as C-C#.-D-C. If an attempt is made to resolve a dissonant note where one does not exist (for example, between E and F in C+), one of the neighbouring notes is selected instead.

In some embodiments, motifs can be generated based on a desired type (e.g. an end motif, which is one that could be found at the end of a block 260 or section 250, or a regular motif, which is one that could be found elsewhere in a block 260 or section 250, or either). In other embodiments, motifs can be generated that are typical for different instruments 330 (piano vs. violin vs. guitar vs. electronic etc.).

In any event, the line producer 220*c* maps the motif pattern onto a previously generated harmonic pattern by: converting the motif pattern to a harmony adjusted motif based on the previously generated harmonic pattern; bringing each note in the motif pattern into a range of a previously generated mode; and resolving each note in the motif pattern into at least one of a pitch of the previously generated mode and a nearby dissonant note, based on the harmonic chords in the previously generated harmonic pattern.

Collaboration Between Musicians

Generating a harmonic structure for a musical piece enables groups of musicians 320 to perform a piece together which will sound musically coordinated. As previously noted, the line producer 220*c* is the entity in the pipeline 210 which resolves motifs into notes that fit into chords within a mode. When multiple musicians 320 are playing together in an Ensemble, the harmonic structure of the block being generated is determined (e.g. a harmonic pattern is chosen), and then each musical line 270 is generated based on this same harmonic pattern. The result is that even though each musician 320 is playing a different musical line 270 from the others (and possibly different instruments 330, each with its own range), at any given time, each musician 320 can be playing a motif which fits into the current harmonic chord and mode for the piece. It is understood that this is not meant to imply that every note each musician 320 plays will be consonant with all other notes sounding at that time—that would be musically uninteresting. Rather, musicians 320 might be playing passing tones, ornaments, dissonant notes, and so on, but the harmonic analysis of each of their musical lines will be similar.

Choice of Mode

Music can be generated in the application M in any mode which can be supported by the technology used to drive the output device 115. For example, in some non-limiting embodiments, music can be generated in the application M in any mode which can be supported by the output format. This is a very flexible implementation which allows music played to be played in any major or minor key, or using a whole-tone scale, chromatic scale, blues scale, Japanese scale etc. The restrictions imposed by an output format are illustrated using the non-limiting example of the output format being the MIDI format. The restrictions imposed by the MIDI format on the scale are that the period of repetition for the scale is an octave, and that the smallest distance between two notes is a semi-tone. Thus, an octave is divided into 12 semi-tones, designated by consecutive whole numbers in the MIDI format (i.e. 0, 1, 2, 3, 4, 5, 6, 7, 8, 9, 10, 11). Note that these are "normal" restrictions for Western music. The pattern of the scale is stored using offsets from the starting note of the scale. These offsets specify the number of semi-tones between steps in the scale. For example, every major scale has the following step pattern: 0, 2, 4, 5, 7, 9, 11. To specify which major scale is desired, we also store the starting note of the scale, which is a whole number between 0 and 11 which corresponds to an offset from MIDI pitch 0, which represents C.

However, motifs can be resolved into any mode, regardless of the mode in which they were originally specified. While some motifs might sound strange if the mode into which they are resolved contains less tones than the mode in which they were designed, the situation can be resolved using any suitable method. For example, in some non-limiting embodiments, a resolution method which can be used is that the notes are "wrapped around" using a modulus-style 360° computation (i.e., the sixth note in a five note mode becomes the first note one octave higher).

Flexibility of Implementation

In some embodiments, flexibility in the application M is enabled via implementing all the key classes as Abstract classes which can be subclassed according to the goals of a programmer. As an example, consider the Abstract class "MotifGenerator" (i.e. motif generator 230*e*). Now suppose that a developer wishes to have a "MotifGenerator" which is designed to create jazz style motifs. This can be accomplished by writing a class, "JazzMotifGenerator", which extends "MotifGenerator", and provides implementations of all the abstract methods. All the other principal classes in the application M can follow this same pattern, and thus the application M is easily extensible and enhanced.

Data structures for the musical elements are also flexible. As previously mentioned, the mode can be anything which is supported by the output format. The piece length can be user defined or determined by the application M. Any available instruments 330 compatible with the output format can be used (e.g. MIDI instruments). Motifs can be as long or as short as desired. Any number of pattern libraries can be developed and used. Any harmonic chords can be defined, which include any number of notes. Musical styles are completely user defined. And so on.

Jam Sessions and Ensembles

In some embodiments, musicians 320 can play together as a coordinated ensemble, in which the musicians perform a piece with a harmonic structure followed by all the musicians 320. In other embodiments, musicians 320 can play together in a jamming mode, in which musicians 320 rely on their own musical knowledge to decide what to play.

Further Non-Limiting Uses of the Application M

In some embodiments, the application M can be processed within a processing unit of the media device 120, such that the application M is an embedded component in an application product such as a video game. In other embodiments, the application M can be processed by the processing unit 110 as a stand-alone music composition application.

In further embodiments, the application M can be implemented as an emotional equalizer. For example, a mood is generally a collection of emotional descriptors, each present to a different degree. Hence an "emotional equalizer" comprising the computing device 199, the output device 115 and the input device 125, could enable a listener to alter a music's mood as it is playing, for example via the input device 125. The "emotional equalizer" could also be either a hardware or a software device which would operate like a stereo equalizer, except that the sliders would be marked with emotional descriptors rather than frequency ranges. So, while listening, rather than turning up the bass in the song, a listener could turn up the "happy."

Furthermore, environmental music could altered based on data received from sensors. For example, the processing unit 110 can be generating music played in an elevator. Sensors in the elevator could detect the number of persons in the elevator and/or their mood. Sensors would then transmit control data (similar to control data 123 or 123*a*) and the application M can adjust the music accordingly.

The application M can further enable Internet based musical collaboration. For example, three users collaborating via the Internet, each of whom has a collection of musicians 320, with different qualities and abilities, could cause those musicians 320 to perform together and the results could be heard by all the users.

Those skilled in the art will appreciate that in some embodiments, the functionality of the application M may be implemented using pre-programmed hardware or firmware elements (e.g., application specific integrated circuits (ASICs), electrically erasable programmable read-only memories (EEPROMs), etc.), or other related components. In other embodiments, the functionality of the application M may be achieved using a computing apparatus that has access to a code memory (not shown) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Alternatively, the computer-readable program code could be stored remotely but transmittable to these components via a modem or other interface device connected to a network (including, without limitation, the Internet) over a transmission medium. The transmission medium may be either a non-wireless medium (e.g., optical and/or digital and/or analog communications lines) or a wireless medium (e.g., microwave, infrared, free-space optical or other transmission schemes) or a combination thereof.

Persons skilled in the art will appreciate that there are yet more alternative implementations and modifications possible for implementing the embodiments, and that the above implementations and examples are only illustrations of one or more embodiments. The scope, therefore, is only to be limited by the claims appended hereto.

What is claimed is:

1. A flexible music composition engine, comprising, a processing unit enabled for:

creating a pipeline for coordinating a generation of a musical piece;

loading at least one producer into said pipeline, said at least one producer being for producing at least one high level musical element of said musical piece, each of said at least one producer producing said at least one high level musical element independent of other producers in said pipeline;

calling at least one generator through said at least one producer, said at least one generator being for generating at least one low level musical element of said musical piece; and integrating said at least one low level musical element and said at least one high level musical element, such that said processing unit produces said musical piece in real time.

2. The flexible music composition engine of claim 1, said processing unit being further enabled for:

calling at least one performer object for controlling said generation of said musical piece; and loading said pipeline into said performer object upon initialization of said generation of said musical piece.

3. The flexible music composition of claim 2, wherein said performer object is enabled to make repeated calls on said pipeline until said musical piece is of a given length, and each call of said repeated calls generates at least one block of said musical piece.

4. The flexible music composition engine of claim 1, wherein said at least one producer is enabled to call a plurality of generators, including said at least one generator, each of said plurality of generators being associated with a specific style such that a character of said musical piece changes from said specific style to a different specific style when a new generator is called.

5. The flexible music composition engine of claim 1, wherein said at least one generator is associated with a style of said musical piece, such that said at least one low level musical element provides said musical piece with said style; and wherein said processing unit is further enabled to receive data indicative of a different style and in response trigger said at least one producer to call said generator associated with said different style to change the character of said musical piece in real time.

6. The flexible music composition engine of claim 1, wherein said processing unit is further enabled to monitor at least one setting associated with said generation of said musical piece and, in response to a change in said at least one setting, trigger said at least one producer to call a new generator associated with said setting to change a character of said musical piece in real time.

7. The flexible music composition engine of claim 1 wherein said at least one low level musical element is based on one of the following:

a selected pattern from at least one pattern library;

at least one randomly generated low level music element;

a randomly selected pattern from said pattern library.

8. The flexible music composition engine of claim 7, wherein said at least one randomly generated low level musical element is generated by a method comprising pseudo-randomly generating said at least one low level musical element such that the same low level musical element is generated for a given seed value.

9. The flexible music composition engine of claim 7, wherein said at least one pattern library comprises at least one of a harmonic pattern library, a motif pattern library, a meter pattern library and a mode pattern library.

10. The flexible music composition engine of claim 1, wherein said at least one producer comprises at least one of:

a section producer for producing at least one section of said musical piece;

a block producer for producing at least one block of a section of said musical piece;

a line producer for producing at least one musical line; and an output producer for converting said musical piece to an output format.

11. The flexible music composition engine of claim 10, wherein said at least one generator comprises a structure generator callable by said section producer, said structure generator being for generating said at least one section, such that said section producer produces a linear progression of sections to form a structure of said musical piece.

12. The flexible music composition engine of claim 10, wherein said producing said at least one block of a section of said musical piece comprises sequentially producing blocks until said section is of a given length.

13. The flexible music composition engine of claim 10, wherein said at least one generator is callable by said block producer, and comprises at least one of a harmonic generator for generating a harmonic pattern, a meter generator for generating a meter, and a mode generator for generating a mode.

14. The flexible music composition engine of claim 10, wherein said at least one generator is callable by said line producer and comprises a motif generator for generating a motif pattern independent of a mode and a harmonic pattern, said line producer further enabled to map said motif pattern onto a previously generated harmonic pattern by:

converting the motif pattern to a harmony adjusted motif based on said previously generated harmonic pattern;

bringing each note in said motif pattern into a range of a previously generated mode; and resolving each said note in said motif pattern into at least one of a pitch of said previously generated mode and a nearby dissonant note, based on the harmonic chords in said previously generated harmonic pattern.

15. The flexible music composition engine of claim 1, said processing unit further enabled to convert said musical piece to an output format that is at least one of playable by an output device and storable in a data file.

16. The flexible music composition engine of claim 1, said processing unit further enabled to adjust at least one musical element of said musical piece, such that said musical piece reflects a given emotional character, by:

receiving at least one indication of a given emotional character;

retrieving at least one mood parameter associated with at least one musical element, the at least one mood parameter specifying how said at least one musical element is to be adjusted to reflect said given emotional character;

adjusting said at least one musical element of the music based on said at least one mood parameter.

17. The flexible music composition engine of claim 16, wherein said processing unit is further enabled to adjust said at least one musical element by:

receiving at least one weight parameter specifying the degree to which the music is to be adjusted to reflect said given emotional character, wherein said at least one weight parameter comprises a percentage that the music is to be adjusted to reflect said given emotional character, and wherein said adjusting said at least one mood parameter based on said at least one weight parameter comprises adjusting said at least one mood parameter based on said percentage; and adjusting said at least one mood parameter based on said at least one weight parameter, prior to said adjusting said at least one musical element.

18. The flexible music composition engine of claim 1, further comprising an interface for receiving control data from at least one of a media device and a multimedia application, said interface in communication with said processing unit, such that said processing unit produces said musical piece in real time based on said control data.

19. The flexible music composition engine of claim 18, said media device comprising at least one of a video device, a videogame device, a telephonic device, a personal digital assistant, an audio device, an interactive feedback device, a bio-feedback device, a sound installation, and an interactive book.

20. A method of generating music in real-time, in a computing device including a processing unit, the method executable in said processing unit, the method comprising:

creating a pipeline for coordinating generation of a musical piece;

loading at least one producer into said pipeline, said at least one producer for producing at least one high level musical element of said musical piece, independent of other producers in said pipeline;

calling at least one generator, via said at least one producer, said at least one generator for generating at least one low level musical element of said musical piece; and integrating said at least one low level musical element and said at least one high level musical element, such that said processing unit produces said musical piece in real time.

* * * * *